US012570373B2

(12) United States Patent
Raiola

(10) Patent No.: US 12,570,373 B2
(45) Date of Patent: Mar. 10, 2026

(54) PLEASURE CRAFT HAVING AN IMPROVED DECK CONSTRUCTION

(71) Applicant: Giancarlo Raiola, Angri (IT)

(72) Inventor: Giancarlo Raiola, Angri (IT)

( * ) Notice: Subject to any disclaimer, the term of this patent is extended or adjusted under 35 U.S.C. 154(b) by 700 days.

(21) Appl. No.: 17/923,306

(22) PCT Filed: May 5, 2021

(86) PCT No.: PCT/IB2021/053798
§ 371 (c)(1),
(2) Date: Nov. 4, 2022

(87) PCT Pub. No.: WO2021/224822
PCT Pub. Date: Nov. 11, 2021

(65) Prior Publication Data

US 2023/0227126 A1 Jul. 20, 2023

(30) Foreign Application Priority Data

May 5, 2020 (IT) ..... 102020000009934

(51) Int. Cl.
*B63B 3/52* (2006.01)
*B63B 3/26* (2006.01)
*B63B 3/36* (2006.01)
*B63B 3/48* (2006.01)

(52) U.S. Cl.
CPC ..... *B63B 3/52* (2013.01); *B63B 3/36* (2013.01); *B63B 3/26* (2013.01); *B63B 3/48* (2013.01)

(58) Field of Classification Search
CPC .... B63B 3/52; B63B 3/36; B63B 3/48; B63B 73/00; B63J 2/04
USPC ..... 114/85, 65 R, 83, 343, 77 R, 79 R, 82, 114/78, 84
See application file for complete search history.

(56) References Cited

U.S. PATENT DOCUMENTS 4,658,747 A * 4/1987 Franz ..... B63B 3/08 114/77 R
5,582,124 A * 12/1996 Sikora ..... B63B 3/20 114/65 R
10,526,053 B2 1/2020 Inzadi

FOREIGN PATENT DOCUMENTS

CN 205602056 U 9/2016
DE 4424876 A1 1/1996
DE 202006005371 U1 * 6/2006 ..... B63B 3/68
EP 0790179 A1 8/1997
(Continued)

OTHER PUBLICATIONS

JP_2004082880_A Machine Translation (Year: 2004).*
(Continued)

*Primary Examiner* — S. Joseph Morano
*Assistant Examiner* — Eric Anthony Starck
(74) *Attorney, Agent, or Firm* — Howson & Howson LLP

(57) ABSTRACT

A pleasure craft is provided in which one or more decks of the craft have a deck construction in which a base body is provided, and in which a first part of supporting and stiffening members is arranged on an upper face of the base body, and a second part of the supporting and stiffening members is arranged on a lower face of the base body. This construction optimizes and rationalizes the arrangement of components of the installations of the craft in terms of size, weight and the required amount of space, as well as in terms of required power, this resulting in a reduction of time and cost for mounting the installations of the craft.

18 Claims, 5 Drawing Sheets

(56) References Cited

FOREIGN PATENT DOCUMENTS

| | | | | | |
|---|---|---|---|---|---|
| IT | TO20110710 | A1 | | 2/2013 | |
| JP | 2004082880 | A | * | 3/2004 | |
| JP | 2005041371 | A | * | 2/2005 | |
| JP | 2019006276 | A | * | 10/2019 | |
| WO | WO-2010114369 | A2 | * | 10/2010 | ..... B63B 15/00 |

OTHER PUBLICATIONS

JP_2005041371_A Machine Translation (Year: 2005).*
DE_202006005371_U1 Machine Translation (Year: 2020).*
JP_2019006276_A Machine Translation (Year: 2019).*
Superstructure [online]. Wikipedia.org, 2021 [archived on Jan. 29, 2021]. Retrieved from the Internet: <URL:https://web.archive.org/web/20210129211137/https://en.wikipedia.org/wiki/Superstructure>. (Year: 2021).*
International Search Report and Written Opinion of the International Searching Authority issued for International PCT Application No. PCT/IB2021/53798 on Sep. 14, 2021.

* cited by examiner

PLEASURE CRAFT HAVING AN IMPROVED DECK CONSTRUCTION

TECHNICAL FIELD

The present invention relates to a pleasure craft comprising a main deck, on which a superstructure can be provided, and a hull, the inner space of which is divided into a plurality of overlying decks.

More particularly, the present invention relates to a pleasure craft in which one or more decks have an improved construction, allowing rationalizing the installation of electrical, hydraulic and ventilation/air-conditioning systems.

BACKGROUND ART

Pleasure crafts are known comprising a hull and a main deck, on which a superstructure capable of housing, for example, a passenger cabin and/or the helm station for the craft owner is provided.

Inside the hull, the space is divided into one or more overlying decks, which accommodate further compartments for passengers' use (in addition to those provided on the main deck), as well as the engine room, the compartments for the crew, the rooms for the storage and conservation of materials, and so on.

Also, the inner space of the superstructure provided on the main deck may in turn be dived into a plurality of overlying decks.

A craft of this type is disclosed, for example, in document WO 2010/114369.

For example, other luxury pleasure crafts having a length of over 35 meters (and in particular between 35 meters and 70 meters) comprise, besides and below the main deck, a middle deck (usually referred to as "lower deck" in the technical field of reference) and a lowermost deck (usually referred to as "underlower deck" in the technical field of reference).

Both the lower deck and the underlower deck are provided inside the hull and below the main deck: the lower deck is immediately below the main deck; the underlower deck is located below the lower deck, immediately above the keel of the hull and houses the engine room as well as storage rooms and the like.

Generally, according to prior art the structures of the decks are designed and manufactured with a planking serving as a base body. Flooring coverings (floor plates) for the craft's rooms are applied on the upper face of the planking. On the opposite, lower face, instead, there are arranged all the supporting and stiffening members (longitudinal girders, reinforced beams, etc.).

Starting from this structural configuration, during manufacturing of the craft, on-board installations (such as, for example, ducts and cable conduits of air-conditioning systems, cables for electrical systems, etc.) have to be installed on the lower face of the planking or, in some cases, on the flanks of the vessel.

This results in the need for long, winding paths for the ducts and cables of the systems, which have to pass around and over the supporting and stiffening members.

In addition, this not infrequently makes it difficult to arrange insulation and lining systems (thermal insulation elements, fire insulation elements, etc.) and places constraints on the layout of structures.

Document DE 442486 discloses a base body for the deck of a vessel, comprising a box-like structure consisting of a plurality of tubes with square cross-section, to which an upper covering panel and a lower covering panel are coupled by welding. Between each pair of adjacent tubes, a corresponding cavity is formed between said upper covering panel and said lower covering panel; however, such cavities are not suitable for accommodating components of the installations of the craft, because they are not accessible from the outside (for example, for maintenance or repair purposes).

The main object of the present invention is therefore to overcome the limitations of the prior art by providing a pleasure craft in which the arrangement of the supporting and stiffening members is improved and allows for a more rational design of the installations of the craft.

This and other objects are achieved with a pleasure craft as claimed in the appended claims.

SUMMARY OF INVENTION

The invention provides that one or more decks of the pleasure craft have a construction in which a base body is provided, and in which at least part of the supporting and stiffening members is arranged on the upper face of said base body.

In detail, according to the invention, in one or more decks, a first part of the supporting and stiffening members is arranged on the upper face of the base body, and a second part of the supporting and stiffening members is arranged on the opposite, lower face of the base body.

Advantageously, according to the invention, mutually adjacent supporting and stiffening members arranged on the upper face of the base body define, together with said base body, corresponding upward open seats or channels, which can accommodate components of the installations of the craft (ducts, cable conduits, cables); similarly, mutually adjacent supporting and stiffening members arranged on the lower face of the base body define, together with said base body, corresponding downward open seats or channels, which can accommodate further components of the installations of the craft (ducts, cable conduits, cables).

In a particularly preferred embodiment of the invention, the supporting and stiffening members of said first part of the supporting and stiffening members are all substantially oriented in the same direction with respect to the longitudinal axis of the craft; similarly, also the supporting and stiffening members of said second part of the supporting and stiffening members are all substantially oriented in the same direction with respect to the longitudinal axis of the craft.

For example, the longitudinal girders, substantially parallel to one another and to the longitudinal axis of the craft, are provided on the upper face of the base body, whereas the transverse beams, substantially parallel to one another and perpendicular to the longitudinal axis of the craft, are provided on the lower face of the base body, or vice versa.

However, this particularly preferred embodiment is not to be understood in a limiting sense, and all the combinations within the reach of the persons skilled in the art are possible, including, for example:

- arranging part of the longitudinal girders on the upper face of the base body, part of the longitudinal girders on the lower face of said base body, and the transverse beams on the lower face of said base body;
- arranging part of the longitudinal girders on the lower face of the base body, part of the longitudinal girders on the lower face of said base body, and the transverse on the upper face of said base body;
- arranging part of the longitudinal girders on the upper face of the base body, part of the longitudinal girders on the lower face of said base body, and part of the transverse beams on the upper face of said base body and part of the transverse beams on the lower face of said base body;

arranging the longitudinal girders on the upper face of the base body, and part of the transverse beams on the upper face of said base body and part of the transverse beams on the lower face of said base body;

arranging the longitudinal girders on the upper face of the base body, and part of the transverse beams on the upper face of said base body and part of the transverse beams on the lower face of said base body.

Accordingly, part of the components of the installations of the craft (electrical systems, hydraulic systems, ventilation/air-conditioning systems, . . . ) can be arranged on the lower face of said base body, and part of the components of said installations can be arranged on the opposite, upper face of said base body.

Advantageously, thanks to the invention, it is possible to reduce the number of components of the installations of the craft (ducts, cable conduits, cables) arranged below the base body of the deck and on the flanks of the craft.

The engineering of the installations of the craft will thus advantageously be optimized and rationalized in terms of size, weight and the required amount of space of the components, as well as in terms of required power.

In addition, both times and costs for mounting the installations of the craft will thus be reduced dramatically.

Moreover, the invention allows for reduction or complete elimination of crossings on the flanks of the hull, thus allowing for the provision of vertical passage of the components of the installations, such as tubes and ducts, between different decks of the craft at any point of the craft, without any limitations.

This possibility contributes significantly to reducing production times and costs in terms of both materials and labor.

In addition, the deck construction according to the invention and the resulting rational arrangement of the components of the installations of the craft allow for reducing and optimizing the heights between decks, which results in improved stability of the craft.

Moreover, advantageously, the supporting and stiffening members provided on the upper face of the base body may be integrated in the supporting structure of the floor plates.

According to prior art, dedicated complex metal frames are arranged on the base body for the subsequent laying of floor plates. According to the invention, instead, the supporting and stiffening members provided on the upper face of the base body may partially or completely replace said frames.

This possibility entails obvious advantages in terms of reduction of the number of components, and consequent reduction of installation times and costs, as well as in terms of stability of floor plates.

As according to the invention part of the supporting and stiffening members are arranged on the upper face of the base body and part of the supporting and stiffening members are arranged on the lower face of the base body, the invention has further advantages, related to reduction of the intersections between said supporting and stiffening members (if not to complete elimination thereof in the case where the supporting and stiffening members on the upper face of the base body and the supporting and stiffening members on the lower face of the base body are all substantially oriented in the same direction with respect to the longitudinal axis of said craft), respectively.

Firstly, this results in further improvement of the rationalization of the mounting of installations, as the laying of cable conduits, ducts, cables and the like will not be limited by the intersections of said supporting and stiffening members.

Secondly, the limitation of the intersections between the supporting and stiffening members and the resulting possibility of providing longitudinal girders and/or transverse beams of greater length dramatically reduces the number of weldings to be carried out.

This, in turn, results in clear advantages both from the structural standpoint and from the standpoint of simplifying the production process, including:

reducing or eliminating twisting of the deck constructions due to multi-step welding of a plurality of metal sheet elements of limited length;

reducing or eliminating the difficulties in easily accessing all the welding areas and carrying out high-quality weldings;

reducing the times for carrying out the weldings and the risks of error.

BRIEF DESCRIPTION OF DRAWINGS

Further features and advantages of the invention will become apparent from the following detailed description of a preferred embodiment of the invention, given by way of non-limiting example with reference to the annexed drawings, in which.

DESCRIPTION OF EMBODIMENTS

Below, special reference is made to a luxury pleasure boat, more particularly a yacht.

The invention must not be understood as limited to this type of vessels.

In general, the invention is applicable to pleasure crafts of the type comprising a main deck on which a superstructure can be provided, and a hull, the inner space of which is divided into a plurality of overlying decks.

Figure 1:
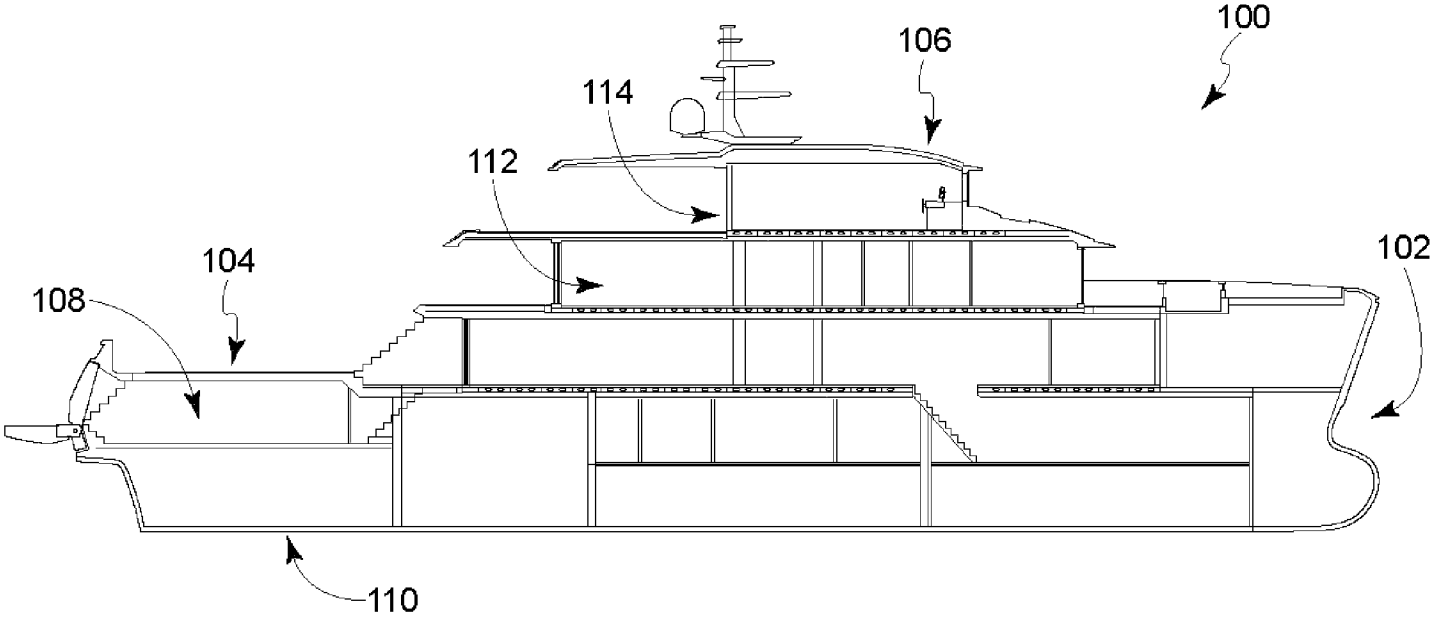
FIG. 1 is a schematic view in longitudinal section of an example of a pleasure craft.

Referring at first to FIG. 1, this schematically illustrates an exemplary pleasure craft 100.

Said craft 100 essentially comprises a hull 102 and a main deck 104, on which a superstructure 106 for the passengers and the craft owner is provided.

The inner space of the hull is divided into one or more overlying decks.

In particular, in the craft illustrated in FIG. 1, the inner space of the hull 102 is divided into two overlying decks, namely a lower deck (or middle deck) 108 and an underlower deck (or lowermost deck) 110.

The inner space of the superstructure 106 as well may possibly be divided into one or more overlying decks.

In particular, in the craft illustrated in FIG. 1, the inner space of the superstructure 106 comprises two overlying decks 112, 114 above the main deck.

It will be apparent to the person skilled in the art that the number of decks inside the hull 102 as well as the number of decks inside the superstructure 106 may also be different.

Figure 2:
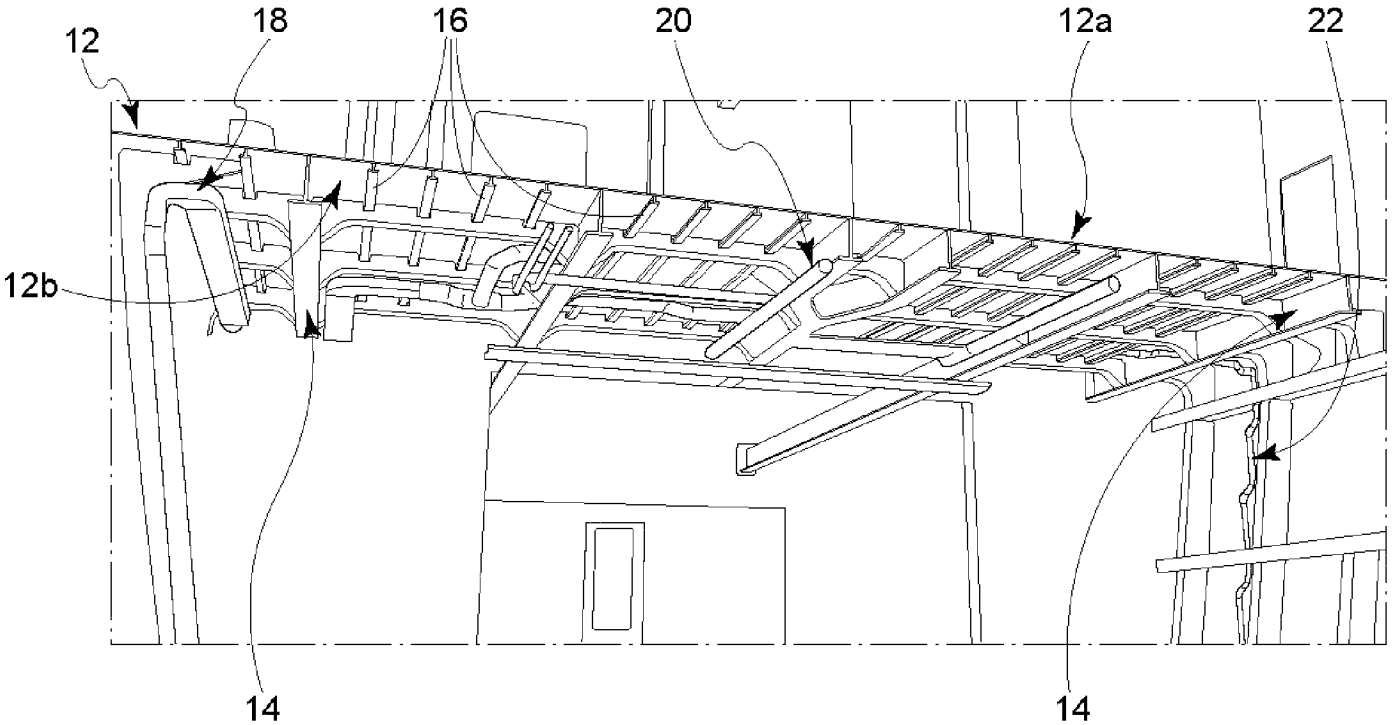
Fig. 2 (PRIOR ART)
FIG. 2 schematically shows a portion of a deck construction of a pleasure craft of the type illustrated in FIG. 1, according to prior art.

FIG. 2 schematically illustrates a portion of the construction of a craft of the type illustrated in FIG. 1, which portion shows the making of deck constructions according to prior art.

As shown in FIG. 2, a deck comprises a base body 12 (planking).

The upper face 12*a* of the base body 12 is flat and intended for laying coverings for the flooring of the deck.

All the supporting and stiffening members 14, 16, instead, are provided entirely on the lower face 12*b* of the base body 12.

Accordingly, all the components of the installations of the craft, too, are provided entirely on the lower face 12*b* of the base body 12.

These components may include ducts and cable conduits 18 of the ventilation/air-conditioning systems, tubes 20 of the hydraulic systems, cables and cable ducts 22 of the electrical systems, etc.

Further components of said installations are provided on the flanks of the hull, as shown in FIG. 2.

Figure 3:
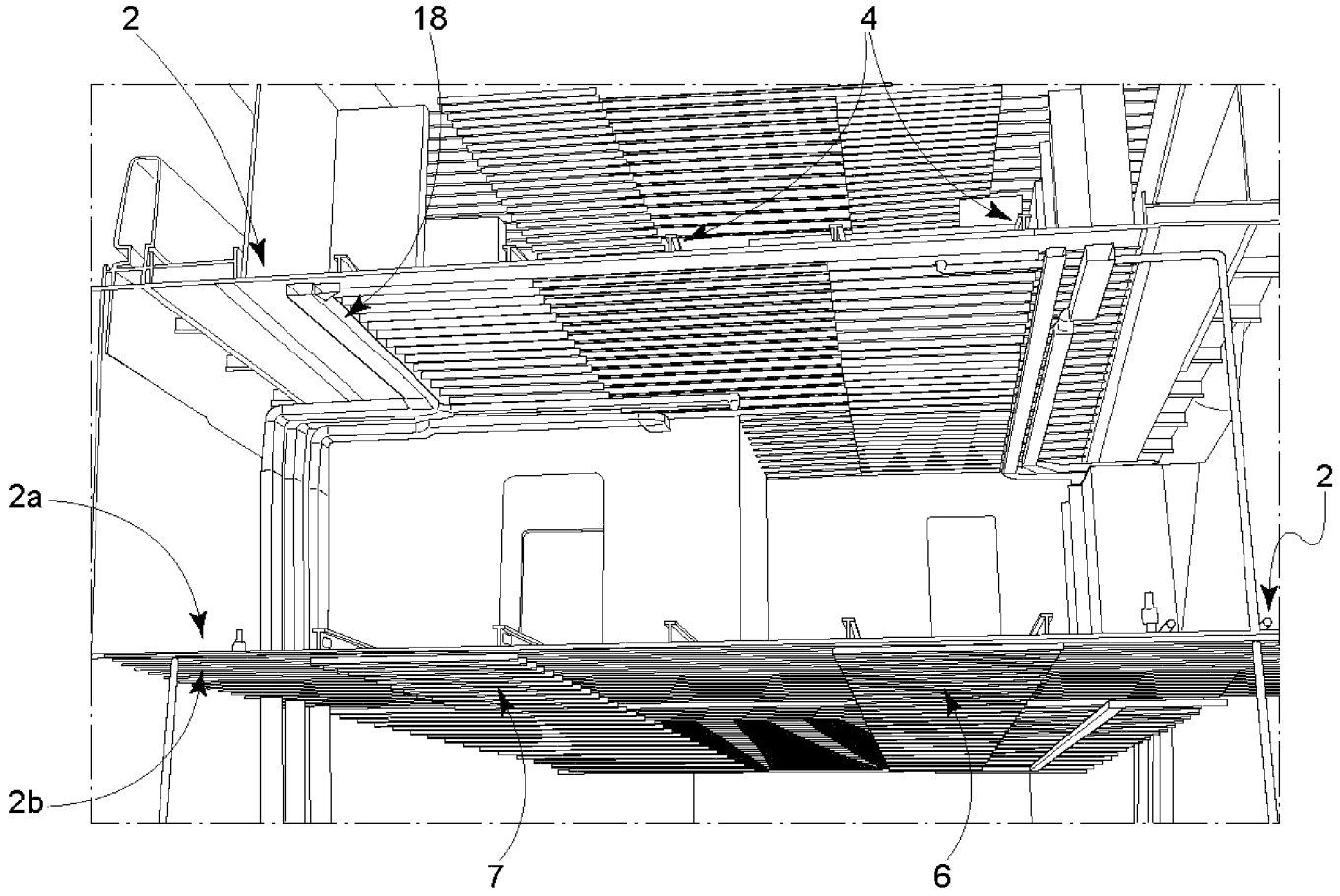
FIG. 3 schematically shows a portion of a deck construction of a pleasure craft of the type illustrated in FIG. 1, according to the invention.
Figure 4:
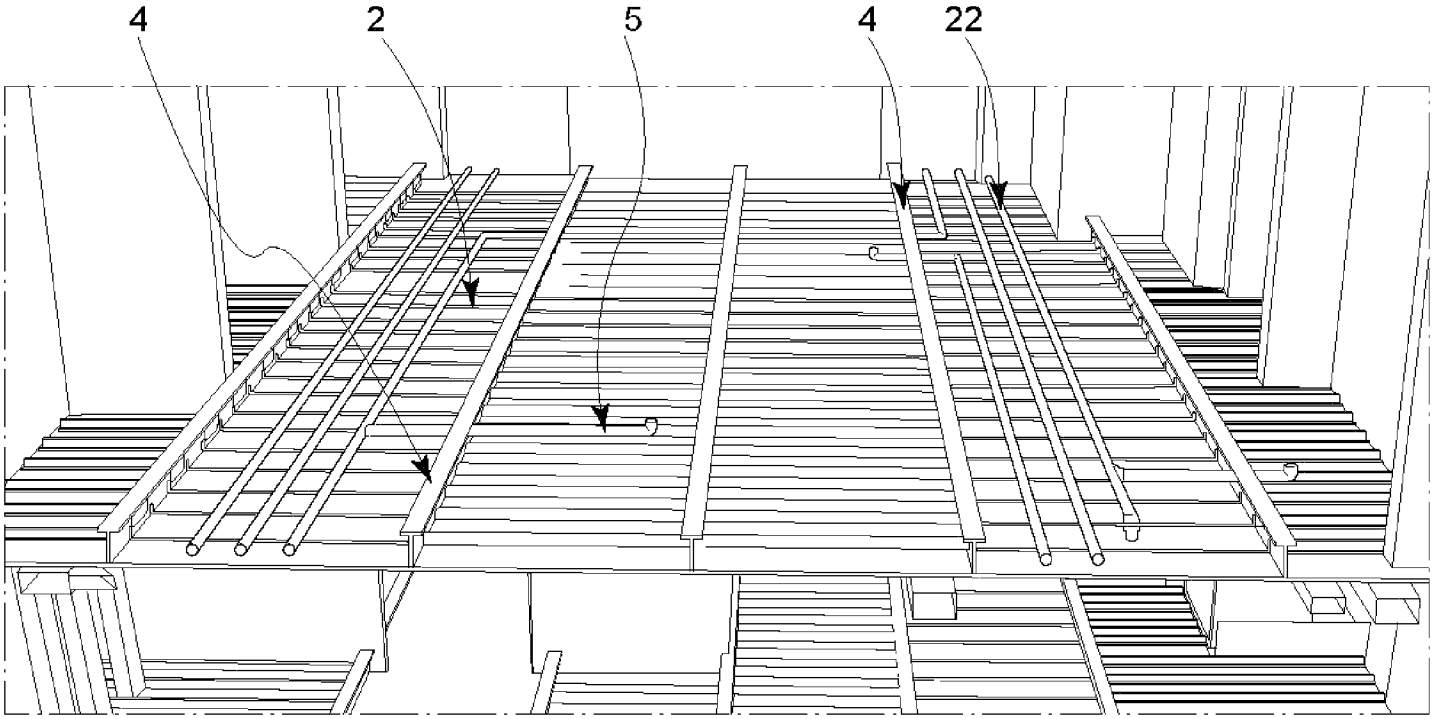
FIG. 4 schematically shows a further portion of the deck construction of a pleasure craft of the type illustrated in FIG. 1, according to the invention.

Turning now to FIGS. 3 and 4, these schematically illustrate portions of the construction of a craft of the type illustrated in FIG. 1, which portions show the making of deck constructions according to the invention.

According to the invention, one or more decks of the craft—in the illustrated embodiment, all the decks of the craft—has/have a base body 2, and at least part of the supporting and stiffening members 4, 6 of the deck(s) is arranged on the upper face of said base body.

In particular, in the described preferred, though in no-way limiting embodiment, one or more decks of the craft—in the illustrated embodiment, all the decks of the craft—has/have a base body 2, on the upper face 2*a* of which there is arranged a first part of the supporting and stiffening members 4, 6 of the deck, and on the lower face 2*b* of which there is arranged a second part of the supporting and stiffening members 4, 6 of the deck.

Preferably, the supporting and stiffening members provided on a same face of the base body 2 are all substantially oriented in the same direction with respect to the longitudinal axis of the craft.

In the illustrated embodiment, the longitudinal girders 4, substantially parallel to one another and to the longitudinal axis of the craft, are provided on the upper face 2*a* of the base body 2, whereas the transverse beams 6, substantially parallel to one another and perpendicular to the longitudinal axis of the craft, are provided on the lower face 2*b* of the base body 2.

It is evident that, in an alternative embodiment of the invention, the longitudinal girders may be provided on the lower face of the base body and the transverse beams may be provided on the upper face of said base body.

It is also evident that, in further alternative embodiments of the invention, it would be possible to devise different configurations in which part of the longitudinal girders and/or transverse beams is arranged on the upper face and part thereof is arranged on the lower face of the base body.

As shown in FIGS. 3 and 4, mutually adjacent supporting and stiffening members arranged on the upper face 2*a* of the base body 2—namely, in the illustrated embodiment, mutually adjacent longitudinal girders 4—define, together with said base body 2, corresponding upward open seats or channels 5; similarly, mutually adjacent supporting and stiffening members arranged on the lower side 2*b* of the base body 2—namely, in the illustrated embodiment, mutually adjacent transverse beams 6—define, together with said base body 2, corresponding downward open seats or channels 7.

As a result, advantageously, part of the components of the installations of the craft (electrical systems, hydraulic systems, ventilation/air-conditioning systems, . . . ) can be arranged on the upper face 2*a* of the base body 2 and housed in said upward open seats or channels 5, and part of the components of said installations can be arranged on the opposite, lower face 2*b* of said base body and housed in said downward open seats or channels 7.

On the upper face 2*a* of the base body 2, and possibly also on the lower face 2*b* of the base body 2, there will be provided covering panels closing said upward open seats or channels 5 and said downward open seats or channels 7, respectively.

However, said panel will be coupled to the base body in a removable manner, so as to provide easy access to components of the installations of the craft in case maintenance or repair operations are required.

In this regard, it should be noted that, advantageously, the supporting and stiffening members provided on the upper face of the base body 2 may be integrated in the supporting structure of the floor plates, thus replacing (either partially or completely) the dedicated metal frames that are used for supporting floor plates in solutions of known type.

According to prior art, said metal frames are later applied to the base body 12 and connected thereto.

On the contrary, in the solution according to the invention, it will be possible to directly exploit the supporting and stiffening members provided on the upper face 2*a* of the base body 2, which are already integrated to said base body 2. Correspondingly, said supporting and stiffening member may be provided with seats or connecting means for installing floor plates.

This will result in a reduction of the times and costs for installing the floor plates, besides ensuring stable, affordable laying thereof.

As mentioned in connection with the solution of known type of FIG. 2, in the construction according to the invention, too, the components of the installations of the craft may include ducts and cable conduits 18 of ventilation/air-conditioning systems, tubes 20 of hydraulic systems, cables and cable conduits 22 of electrical systems, and so on.

Thanks to the fact that on each face 2*a*, 2*b* of the base body 2 there are arranged supporting and stiffening members 4, 6, which are all substantially oriented in the same direction, in the preferred embodiment of the invention described herein, it will be possible to avoid winding paths for the above-mentioned components and the number of intersections will be reduced dramatically.

The engineering of the installations of the craft will thus advantageously be optimized and rationalized in terms of size, weight and the required amount of space of the components, as well as in terms of required power.

In addition, as can be seen in particular in FIG. 3, depending on the requirements of the spaces provided in the different decks, the same component of a system (i.e., a cable conduit, a duct, a cable, etc.) may extend partly over one of the faces of the base body 2 and partly on the opposite face of said base body, while remaining within the overall required amount of space of the supporting and stiffening members 4, 6 of the corresponding deck, simply by providing a through-hole in the base body 2.

Moreover, again by providing a through-hole in the base body 2, a component of a system (namely, a cable conduit, a duct, a cable, etc.) provided on the upper face of the base body 2 may be arranged in the underlying space at any point of the deck and—vice versa—a component of a system (namely, a cable conduit, a duct, a cable, etc.) provided on the lower face of the base body 2 may be arranged in the overlying space at any point of the deck.

The invention thus makes it possible to dramatically reduce (if not completely eliminate) crossings on the flanks of the hull.

Figure 5:
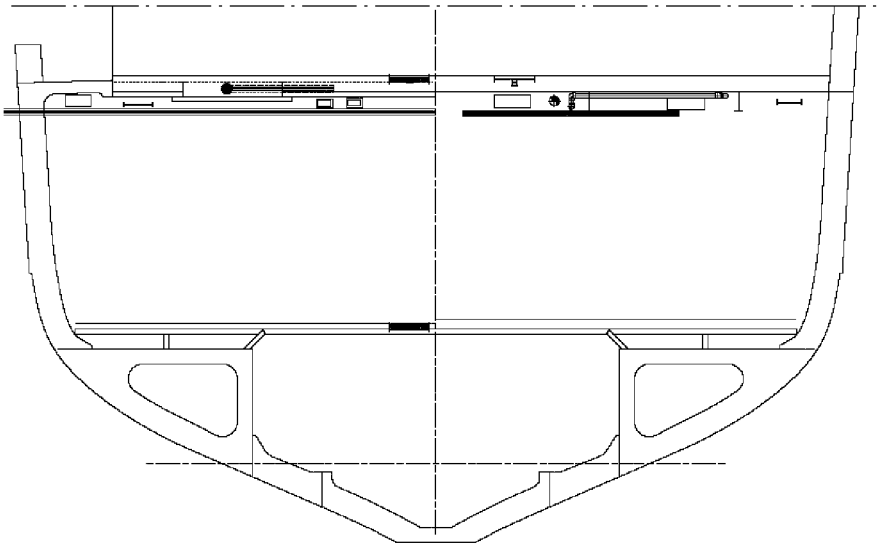
Fig. 5 (PRIOR ART)
FIG. 5 is a partial schematic view in cross-section of a pleasure craft of the type illustrated in FIG. 1, which compares the deck construction according to prior art with the deck construction according to the invention.

The advantages of the invention are also apparent from FIG. 5, in which—still with reference to an exemplary craft of the type illustrated in FIG. 1 (in which the superstructure has been omitted for the sake of clarity)—there are shown the two solutions in comparison with each other, and in particular a deck construction according to prior art in the right portion of FIG. 5 and a deck construction according to the invention in the left portion of FIG. 5.

In any case, it will be apparent to the person skilled in the art that the above detailed description has been given by way of non-limiting example and that several modifications and variants are possible without departing from the scope of the present invention as defined by the appended claims.

The invention claimed is:

1. A pleasure craft (100), of the type comprising a main deck (104) and a hull (102), the inner space of which is divided into several overlying decks (108, 110), wherein said craft has a longitudinal axis, wherein each of said main deck and overlying decks (104, 108, 110) comprises a base body (2), having an upper face (2*a*) and an opposite, lower face (2*b*), and wherein each of said main deck and overlying decks (104, 108, 110) further comprises supporting and stiffening members (4, 6), wherein, in one or more decks of said craft, a first part of either or both of said supporting and stiffening members (4, 6) is arranged on said upper face of said base body, and a second part of either or both of said supporting and stiffening members (4, 6) is arranged on said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7), wherein said supporting and stiffening members comprise a plurality of longitudinal girders (4), substantially parallel to one another and to the longitudinal axis of said craft, and a plurality of transverse beams (6), substantially parallel to one another and perpendicular to the longitudinal axis of said craft, and wherein said supporting and stiffening members arranged on said upper face of said base body are all substantially oriented in the same direction with respect to the longitudinal axis of said craft, and wherein said supporting and stiffening members arranged on said lower face of said base body are all substantially oriented in the same direction with respect to the longitudinal axis of said craft.

2. A pleasure craft (100), of the type comprising a main deck (104) and a hull (102), the inner space of which is divided into several overlying decks (108, 110), wherein said craft has a longitudinal axis, wherein each of said main deck and overlying decks (104, 108, 110) comprises a base body (2), having an upper face (2*a*) and an opposite, lower face (2*b*), and wherein each of said main deck and overlying decks (104, 108, 110) further comprises supporting and stiffening members (4, 6), wherein, in one or more decks of said craft, a first part of either or both of said supporting and stiffening members (4, 6) is arranged on said upper face of said base body, and a second part of either or both of said supporting and stiffening members (4, 6) is arranged on said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7), wherein said supporting and stiffening members comprise a plurality of longitudinal girders (4), substantially parallel to one another and to the longitudinal axis of said craft, and a plurality of transverse beams (6), substantially parallel to one another and perpendicular to the longitudinal axis of said craft, and wherein, in one or more decks, the supporting and stiffening members are arranged according to the following configuration:

said longitudinal girders (4) are all provided on said lower face (2*b*) of said base body (2) and said transverse beams (6) are all provided on said upper face (2*a*) of said base body (2).

3. A pleasure craft (100), of the type comprising a main deck (104) and a hull (102), the inner space of which is divided into several overlying decks (108, 110), wherein said craft has a longitudinal axis, wherein each of said main deck and overlying decks (104, 108, 110) comprises a base body (2), having an upper face (2*a*) and an opposite, lower face (2*b*), and wherein each of said main deck and overlying decks (104, 108, 110) further comprises supporting and stiffening members (4, 6), wherein, in one or more decks of said craft, a first part of either or both of said supporting and stiffening members (4, 6) is arranged on said upper face of said base body, and a second part of either or both of said supporting and stiffening members (4, 6) is arranged on said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7), wherein said supporting and stiffening members comprise a plurality of longitudinal girders (4), substantially parallel to one another and to the longitudinal axis of said craft, and a plurality of transverse beams (6), substantially parallel to one another and perpendicular to the longitudinal axis of said craft, and wherein, in one or more decks, the supporting and stiffening members are arranged according to the following configuration:

said longitudinal girders (4) are provided partly on said lower face (2*b*) and partly on said upper face (2*a*) of said base body (2) and said transverse beams (6) are all provided on said upper face (2*a*) of said base body (2).

4. A pleasure craft (100), of the type comprising a main deck (104) and a hull (102), the inner space of which is divided into several overlying decks (108, 110), wherein said craft has a longitudinal axis, wherein each of said main deck and overlying decks (104, 108, 110) comprises a base body (2), having an upper face (2*a*) and an opposite, lower face (2*b*), and wherein each of said main deck and overlying decks (104, 108, 110) further comprises supporting and stiffening members (4, 6), wherein, in one or more decks of said craft, a first part of either or both of said supporting and stiffening members (4, 6) is arranged on said upper face of said base body, and a second part of either or both of said supporting and stiffening members (4, 6) is arranged on said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7), wherein said supporting and stiffening members comprise a plurality of longitudinal girders (4), substantially parallel to one another and to the longitudinal axis of said craft, and a plurality of transverse beams (6), substantially parallel to one another and perpendicular to the longitudinal axis of said craft, and wherein, in one or more decks, the supporting and stiffening members are arranged according to the following configuration:

said longitudinal girders (4) are provided partly on said lower face (2*b*) and partly on said upper face (2*a*) of said base body (2) and said transverse beams (6) are all provided on said lower face (2*b*) of said base body (2).

5. A pleasure craft (100), of the type comprising a main deck (104) and a hull (102), the inner space of which is divided into several overlying decks (108, 110), wherein said craft has a longitudinal axis, wherein each of said main deck and overlying decks (104, 108, 110) comprises a base body (2), having an upper face (2*a*) and an opposite, lower face (2*b*), and wherein each of said main deck and overlying decks (104, 108, 110) further comprises supporting and stiffening members (4, 6), wherein, in one or more decks of said craft, a first part of either or both of said supporting and stiffening members (4, 6) is arranged on said upper face of said base body, and a second part of either or both of said supporting and stiffening members (4, 6) is arranged on said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7), wherein said supporting and stiffening members comprise a plurality of longitudinal girders (4), substantially parallel to one another and to the longitudinal axis of said craft, and a plurality of transverse beams (6), substantially parallel to one another and perpendicular to the longitudinal axis of said craft, and wherein, in one or more decks, the supporting and stiffening members are arranged according to the following configuration:

said longitudinal girders (4) are all provided on said lower face (2*b*) of said base body (2) and said transverse beams (6) are provided partly on said upper face (2*a*) and partly on said lower face (2*b*) of said base body (2).

6. A pleasure craft (100), of the type comprising a main deck (104) and a hull (102), the inner space of which is divided into several overlying decks (108, 110), wherein said craft has a longitudinal axis, wherein each of said main deck and overlying decks (104, 108, 110) comprises a base body (2), having an upper face (2*a*) and an opposite, lower face (2*b*), and wherein each of said main deck and overlying decks (104, 108, 110) further comprises supporting and stiffening members (4, 6), wherein, in one or more decks of said craft, a first part of either or both of said supporting and stiffening members (4, 6) is arranged on said upper face of said base body, and a second part of either or both of said supporting and stiffening members (4, 6) is arranged on said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7), wherein said supporting and stiffening members comprise a plurality of longitudinal girders (4), substantially parallel to one another and to the longitudinal axis of said craft, and a plurality of transverse beams (6), substantially parallel to one another and perpendicular to the longitudinal axis of said craft, and wherein, in one or more decks, the supporting and stiffening members are arranged according to the following configuration:

said longitudinal girders (4) are all provided on said upper face (2*a*) of said base body (2) and said transverse beams (6) are provided partly on said upper face (2*a*) and partly on said lower face (2*b*) of said base body (2).

7. The pleasure craft (100) according to claim 1, wherein said craft comprises installations including ventilation/air-conditioning systems, hydraulic systems and electrical systems, wherein said systems comprise cable conduits, ducts, pipes, and cables, and wherein part of said cable conduits, ducts, pipes, and cables is arranged on said upper face (2*a*) of said base body (2) and housed in said upward open seats or channels (5) and part of said cable conduits, ducts, pipes, and cables is arranged on said lower face (2*b*) of said base body (2) and housed in said downward open seats or channels (7).

8. The pleasure craft (100) according to claim 2, wherein said craft comprises installations including ventilation/air-conditioning systems, hydraulic systems and electrical systems, wherein said systems comprise cable conduits, ducts, pipes, and cables, and wherein part of said cable conduits, ducts, pipes, and cables is arranged on said upper face (2*a*) of said base body (2) and housed in said upward open seats or channels (5) and part of said cable conduits, ducts, pipes, and cables is arranged on said lower face (2*b*) of said base body (2) and housed in said downward open seats or channels (7).

9. The pleasure craft (100) according to claim 3, wherein said craft comprises installations including ventilation/air-conditioning systems, hydraulic systems and electrical systems, wherein said systems comprise cable conduits, ducts, pipes, and cables, and wherein part of said cable conduits, ducts, pipes, and cables is arranged on said upper face (2*a*) of said base body (2) and housed in said upward open seats or channels (5) and part of said cable conduits, ducts, pipes, and cables is arranged on said lower face (2*b*) of said base body (2) and housed in said downward open seats or channels (7).

10. The pleasure craft (100) according to claim 4, wherein said craft comprises installations including ventilation/air-conditioning systems, hydraulic systems and electrical systems, wherein said systems comprise cable conduits, ducts, pipes, and cables, and wherein part of said cable conduits, ducts, pipes, and cables is arranged on said upper face (2*a*) of said base body (2) and housed in said upward open seats or channels (5) and part of said cable conduits, ducts, pipes, and cables is arranged on said lower face (2*b*) of said base body (2) and housed in said downward open seats or channels (7).

11. The pleasure craft (100) according to claim 5, wherein said craft comprises installations including ventilation/air-conditioning systems, hydraulic systems and electrical systems, wherein said systems comprise cable conduits, ducts, pipes, and cables, and wherein part of said cable conduits, ducts, pipes, and cables is arranged on said upper face (2*a*) of said base body (2) and housed in said upward open seats or channels (5) and part of said cable conduits, ducts, pipes, and cables is arranged on said lower face (2*b*) of said base body (2) and housed in said downward open seats or channels (7).

12. The pleasure craft (100) according to claim 6, wherein said craft comprises installations including ventilation/air-conditioning systems, hydraulic systems and electrical systems, wherein said systems comprise cable conduits, ducts, pipes, and cables, and wherein part of said cable conduits, ducts, pipes, and cables is arranged on said upper face (2*a*) of said base body (2) and housed in said upward open seats or channels (5) and part of said cable conduits, ducts, pipes, and cables is arranged on said lower face (2*b*) of said base body (2) and housed in said downward open seats or channels (7).

13. The pleasure craft (100) according to claim 1, wherein a superstructure (106) is provided on said main deck, wherein the inner space of said superstructure (106) is divided into overlying decks (112, 114), wherein said overlying decks (112, 114) of said superstructure (106) comprise a base body (2) having an upper face (2*a*) and an opposite, lower face (2*b*), wherein each of said overlying decks (112, 114) of said superstructure further comprises supporting and stiffening members (4, 6), and wherein, in one or more of the overlying decks of said superstructure, a first part of either or both of said supporting and stiffening members (4, 6) is arranged on said upper face of said base body, and a second part of said supporting and stiffening members (4, 6), is arranged on either or both of said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7).

14. The pleasure craft (100) according to claim 2, wherein a superstructure (106) is provided on said main deck, wherein the inner space of said superstructure (106) is divided into overlying decks (112, 114), wherein said overlying decks (112, 114) of said superstructure (106) comprise a base body (2) having an upper face (2*a*) and an opposite, lower face (2*b*), wherein each of said overlying decks (112, 114) of said superstructure further comprises supporting and stiffening members (4, 6), and wherein, in one or more of the overlying decks of said superstructure, a first part of either or both of said supporting and stiffening members (4, 6) is arranged on said upper face of said base body, and a second part of said supporting and stiffening members (4, 6), is arranged on either or both of said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7).

15. The pleasure craft (100) according to claim 3, wherein a superstructure (106) is provided on said main deck, wherein the inner space of said superstructure (106) is divided into overlying decks (112, 114), wherein said overlying decks (112, 114) of said superstructure (106) comprise a base body (2) having an upper face (2*a*) and an opposite, lower face (2*b*), wherein each of said overlying decks (112, 114) of said superstructure further comprises supporting and stiffening members (4, 6), and wherein, in one or more of the overlying decks of said superstructure, a first part of either or both of said supporting and stiffening members (4, 6) is arranged on said upper face of said base body, and a second part of said supporting and stiffening members (4, 6), is arranged on either or both of said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7).

16. The pleasure craft (100) according to claim 4, wherein a superstructure (106) is provided on said main deck, wherein the inner space of said superstructure (106) is divided into overlying decks (112, 114), wherein said overlying decks (112, 114) of said superstructure (106) comprise a base body (2) having an upper face (2*a*) and an opposite, lower face (2*b*), wherein each of said overlying decks (112, 114) of said superstructure further comprises supporting and stiffening members (4, 6), and wherein, in one or more of the overlying decks of said superstructure, a first part of either or both of said supporting and stiffening members (4, 6) is arranged on said upper face of said base body, and a second part of said supporting and stiffening members (4, 6), is arranged on either or both of said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7).

17. The pleasure craft (100) according to claim 5, wherein a superstructure (106) is provided on said main deck, wherein the inner space of said superstructure (106) is divided into overlying decks (112, 114), wherein said overlying decks (112, 114) of said superstructure (106) comprise a base body (2) having an upper face (2*a*) and an opposite, lower face (2*b*), wherein each of said overlying decks (112, 114) of said superstructure further comprises supporting and stiffening members (4, 6), and wherein, in one or more of the overlying decks of said superstructure, a first part of either or both of said supporting and stiffening members (4, 6) is arranged on said upper face of said base body, and a second part of said supporting and stiffening members (4, 6), is arranged on either or both of said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7).

18. The pleasure craft (100) according to claim 6, wherein a superstructure (106) is provided on said main deck, wherein the inner space of said superstructure (106) is divided into overlying decks (112, 114), wherein said overlying decks (112, 114) of said superstructure (106) comprise a base body (2) having an upper face (2*a*) and an opposite, lower face (2*b*), wherein each of said overlying decks (112, 114) of said superstructure further comprises supporting and stiffening members (4, 6), and wherein, in one or more of the overlying decks of said superstructure, a first part of either or both of said supporting and stiffening members (4, 6) is arranged on said upper face of said base body, and a second part of said supporting and stiffening members (4, 6), is arranged on either or both of said lower face of said base body, wherein mutually adjacent supporting and stiffening members (4, 6) arranged on said upper face (2*a*) of said base body (2) define, together with said base body (2), corresponding upward open seats or channels (5), and mutually adjacent supporting and stiffening members (4, 6) arranged on said lower face (2*b*) of said base body (2) define, together with said base body (2), corresponding downward open seats or channels (7).

* * * * *